US010907863B2

(12) United States Patent
Sethi et al.

(10) Patent No.: US 10,907,863 B2
(45) Date of Patent: Feb. 2, 2021

(54) AIR CONDITIONING SYSTEMS AND METHODS

(71) Applicant: HONEYWELL INTERNATIONAL INC., Morris Plains, NJ (US)

(72) Inventors: Ankit Sethi, Buffalo, NY (US); Samuel F. Yana Motta, East Amherst, NY (US); Elizabet del Carmen Vera Becerra, Amherst, NY (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 750 days.

(21) Appl. No.: 15/434,400

(22) Filed: Feb. 16, 2017

(65) Prior Publication Data

US 2017/0191705 A1 Jul. 6, 2017

Related U.S. Application Data

(63) Continuation-in-part of application No. 15/400,891, filed on Jan. 6, 2017, now abandoned.

(60) Provisional application No. 62/295,731, filed on Feb. 16, 2016, provisional application No. 62/275,382, filed on Jan. 6, 2016.

(51) Int. Cl.

| | |
|---|---|
| ***F25B 7/00*** | (2006.01) |
| ***F25B 13/00*** | (2006.01) |
| ***F25B 41/00*** | (2006.01) |
| ***F25B 41/04*** | (2006.01) |

(52) U.S. Cl.
CPC ..... *F25B 7/00* (2013.01); *F25B 13/00* (2013.01); *F25B 41/003* (2013.01); *F25B 41/043* (2013.01); *F25B 2313/0292* (2013.01); *F25B 2500/222* (2013.01)

(58) Field of Classification Search
CPC ..... F25B 7/00; F25B 41/043; F25B 41/003; F25B 13/00; F25B 2500/222; F25B 2313/0292; F28D 20/00; F28D 20/02
See application file for complete search history.

(56) References Cited

U.S. PATENT DOCUMENTS

| | | | | |
|---|---|---|---|---|
| 5,228,301 A * | 7/1993 | Sjoholm | B60H 1/00007 165/263 |
| 2009/0120117 A1* | 5/2009 | Martin | F25B 25/005 62/246 |
| 2012/0126187 A1* | 5/2012 | Low | C09K 5/045 252/602 |
| 2016/0258657 A1* | 9/2016 | Feng | F25B 25/005 |

* cited by examiner

*Primary Examiner* — Emmanuel E Duke
(74) *Attorney, Agent, or Firm* — Colleen D. Szuch

(57) ABSTRACT

Refrigerant systems for conditioning air and/or items located within a dwelling including a high temperature refrigerant circulation loop located substantially outside of the dwelling and a low temperature transfer circuit, which contains HCFO-1233zd(E) substantially inside of the dwelling and at least one intermediate heat exchanger which permits exchange of heat between the high temperature circuit and the HFCO-1233zd(E) in the low temperature heat transfer circuit.

20 Claims, 5 Drawing Sheets

AIR CONDITIONING SYSTEMS AND METHODS

CROSS-REFERENCE TO RELATED APPLICATIONS

The present application claims priority to U.S. Provisional Application No. 62/295,731, filed Feb. 16, 2016, and is a continuation-in-part of U.S. application Ser. No. 15/400,891, filed Jan. 6, 2017 which application claims priority to U.S. Provisional Application No. 62/275,382, filed Jan. 6, 2016 the entire contents of which is hereby incorporated by reference.

FIELD OF THE INVENTION

The present invention relates to high efficiency, low-global warming potential ("low GWP") air conditioning and related refrigeration systems and methods that are safe and effective.

BACKGROUND

In a typical air conditioning and refrigerant systems, a compressor is used to compress a heat transfer vapor from a lower to a higher pressure, which in turn adds heat to the vapor. This added heat is typically rejected in a heat exchanger, commonly referred to as a condenser. In the condenser the vapor, at least in major proportion, is condensed to produce a liquid heat transfer fluid at a relatively high pressure. Typically the condenser uses a fluid available in large quantities in the ambient environment, such as ambient outside air, as the heat sink. Once it has been condensed, the high-pressure heat transfer fluid undergoes a substantially isoenthalpic expansion, such as in by passing through an expansion device or valve, where it is expanded to a lower pressure, which in turn results in the fluid undergoing a decrease in temperature. The lower pressure, lower temperature heat transfer fluid from the expansion operation then is typically routed to an evaporator, where it absorbs heat and in so doing evaporates. This evaporation process in turn results in cooling of the fluid or body that it is intended to cool. In typical air conditioning applications, the cooled fluid is the indoor air of the dwelling being air conditioned. In refrigeration systems, the cooling may involve cooling the air inside of a cold box or storage unit. After the heat transfer fluid is evaporated at low pressure in the evaporator, it is returned to the compressor where the cycle begins once again.

A complex and interrelated combination of factors and requirements is associated with forming efficient, effective and safe air conditioning systems that are at the same time environmentally friendly, that is, have both low GWP impact and low ozone depletion ("ODP") impact. With respect to efficiency and effectiveness, it is important for the heat transfer fluid to operate in air conditioning systems with high levels of efficiency and high capacity. At the same time, since it is possible that the heat transfer fluid may escape over time into the atmosphere, it is important for the fluid to have low values for both GWP and ODP.

While certain fluids are able to achieve high levels of both efficiency and effectiveness and at the same time low levels of both GWP and ODP, applicants have come to appreciate that many fluids which satisfy this combination of requirements nevertheless suffer from the disadvantage of having deficiencies in connection with safety. For example, fluids which might otherwise be acceptable may be disfavored for use because of flammability properties and/or toxicity concerns. Applicants have come to appreciate that the use of fluids having such properties is especially undesirable in typical air conditioning systems since such flammable and/or toxic fluids may inadvertently be released into the dwelling which is being cooled (or being heated in the case of heat-pump applications), thus exposing or potentially exposing the occupants thereof to dangerous conditions.

SUMMARY

According to one aspect of the invention, a refrigerant system is provided for conditioning air and/or items located within a dwelling occupied by humans or other animals. Preferred embodiments of such systems include at least a first heat transfer circuit, which preferably comprises a first heat transfer fluid in a vapor/compression circulation loop, located substantially outside of the dwelling. This first circuit is sometimes referred to herein by way of convenience as the "outdoor loop." The outdoor loop preferably comprises a compressor, a heat exchanger which serves to condense the heat transfer fluid in the outdoor loop, preferably by heat exchange with outdoor ambient air, and an expansion device. The preferred system also includes at least a second heat transfer circuit, which contains a second heat transfer fluid, which is different than said first heat transfer fluid, located substantially inside of the dwelling. This second circuit is sometimes referred to herein by way of convenience as the "indoor loop." The indoor loop preferably comprises an evaporator heat exchanger which serves to evaporate the second heat transfer fluid in the indoor loop, preferably by heat exchange with indoor air. In preferred embodiments, the second heat transfer circuit does not include a vapor compressor.

The preferred systems preferably include at least one intermediate heat exchanger which permits exchange of heat between the first heat transfer fluid and the second heat transfer fluid such that heat is transferred to the first heat transfer fluid, preferably thereby evaporating the first heat transfer fluid, and from the second heat transfer fluid, thereby condensing the second heat transfer fluid. Preferably, the intermediate heat exchanger is located outside the dwelling or outside the area in which the air is being conditioned An important aspect of the preferred systems is that the first heat transfer fluid comprises a refrigerant which has a GWP of not greater than about 500, more preferably not greater than about 400, and even more preferably not greater than about 150 and that the second heat transfer fluid comprises a refrigerant that also has a GWP of not greater than about 500, more preferably not greater than about 400, and even more preferably less than 150 and which has a low flammability and a low toxicity, and even more preferably a flammability that is substantially less than the flammability of the refrigerant in the first heat transfer fluid and/or a toxicity that is substantially less than the toxicity of the refrigerant in said first heat transfer fluid.

In preferred embodiments, the first heat transfer fluid comprises a refrigerant which has a GWP of not greater than about 500 and that the second heat transfer fluid comprises a refrigerant that also has a GWP of not greater than about 500 and which has a flammability that is substantially less than the flammability of the refrigerant in the first heat transfer fluid and/or a toxicity that is substantially less than the toxicity of the refrigerant in said first heat transfer fluid.

In preferred embodiments, the first heat transfer fluid comprises a refrigerant which has a GWP of not greater than about 400 and that the second heat transfer fluid comprises a refrigerant that also has a GWP of not greater than about 400 and which has a flammability that is substantially less than the flammability of the refrigerant in the first heat transfer fluid and/or a toxicity that is substantially less than the toxicity of the refrigerant in said first heat transfer fluid.

In preferred embodiments, the first heat transfer fluid comprises a refrigerant which has a GWP of not greater than about 150 and that the second heat transfer fluid comprises a refrigerant that also has a GWP of not greater than about 150 and which has a flammability that is substantially less than the flammability of the refrigerant in the first heat transfer fluid and/or a toxicity that is substantially less than the toxicity of the refrigerant in said first heat transfer fluid.

In preferred embodiments the second refrigerant comprises, more preferably comprises at least about 50% by weight and even more preferably at least about 75% by weight, of trans-1-chloro-3,3,3-trifluoropropene (HCFO-1233zd(E)), and the first refrigerant has a flammability greater than, and preferably substantially greater than, the flammability of HCFO-1233zd(E).

In preferred embodiments the second refrigerant comprises, more preferably comprises at least about 75% by weight and even more preferably at least about 80% by weight, of trans-1-chloro-3,3,3-trifluoropropene (HCFO-1233zd(E)), and the first refrigerant has a flammability greater than, and preferably substantially greater than, the flammability of HCFO-1233zd(E).

DETAILED DESCRIPTION OF PREFERRED EMBODIMENTS

Preferred Heat Transfer Compositions

Figure 1:
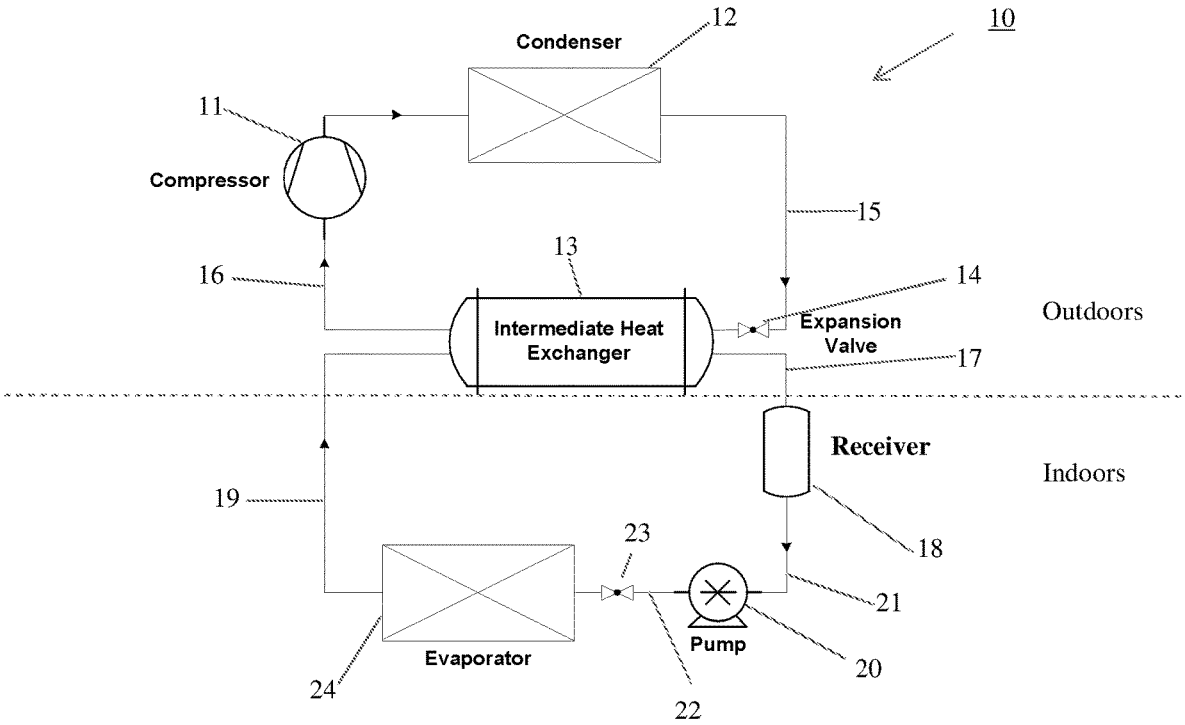
FIG. 1 is a generalized process flow diagram of one preferred embodiment of an air conditioning system according to the present invention.

In each of the embodiments described herein the system includes a first heat transfer composition comprising a first refrigerant and preferably lubricant for the compressor, and a second heat transfer composition comprising a second refrigerant. Preferably the second refrigerant, which comprises at least about 50%, more preferably at least about 80% by weight of trans1-chloro-3,3,3-trifluoropropene (HCFO-1233zd(E)) or at least about 75% by weight, more preferably at least about 80% by weight of trans1,3,3,3-tetrafluoropropene (HFO-1234ze(E)), is a low flammability and low toxicity refrigerant, preferably with a Class A toxicity according to ASHRAE Standard 34 and a flammability of Class 1 or Class 2 or Class 2L. In highly preferred embodiments, the second refrigerant comprises at least about 95% by weight, and in some embodiments consists essentially of or consists of, HFCO-1233zd(E).

In highly preferred embodiments, the second refrigerant comprises from about 95% by weight to about 99% of a five carbon saturated hydrocarbon, preferably one or more of iso-pentane, n-pentane or neo-pentane, and in preferred aspects of such embodiments the combination of said HFCO-1233zd(E) and said pentane is in the form of an azeotropic composition.

In highly preferred embodiments, the second refrigerant comprises from about 85% to about 90% by weight of by weight of trans1,3,3,3-tetrafluoropropene (HFO-1234ze(E)) and from about 10% by weight to about 15% by weight of 1,1,1,2,3,3,3-heptafluoropropane (HFC-227ea), and even more preferably in some embodiments about 88% of trans1,3,3,3-tetrafluoropropene (HFO-1234ze(E)) and about 12% by weight of 1,1,1,2,3,3,3-heptafluoropropane (HFC-227ea).

In highly preferred embodiments, the second refrigerant comprises from about greater than about 50% by weight to about 67.5 by weight of by weight of trans1,3,3,3-tetrafluoropropene (HFO-1234ze(E)) and from greater than about 9.7% to less than about 50% by weight of HFCO-1233zd(E), and even more preferably in some embodiments about 67% of trans1,3,3,3-tetrafluoropropene (HFO-1234ze(E)) and about 33% by weight of HFCO-1233zd(E). Applicants have found that such preferred embodiments are unexpectedly able to provide a second refrigerant that is at once non-flammable according to ASHRAE Standard 34 (which measures flammability of the initial vapor from fraction of the mixture as would occur in the event of a leak of the refrigerant) and also produces a pressure above about 1 bar in the indoor loop of the refrigeration system.

Those skilled in the art will appreciate in view of the disclosures contained herein that such embodiments of the present invention provide the advantage of utilizing only the relatively safe (low toxicity and low flammability) low GWP refrigerants, which make them highly preferred for use in a location proximate to the humans or other animals occupying a dwelling, as is commonly encountered in air conditioning applications.

Preferably in preferred embodiments the first refrigerant may comprise one or more components that would make the refrigerant substantially less desirable from a toxicity and/or flammability standard than the second refrigerant, and all such first refrigerants are included within the scope of the present invention. For example, the first refrigerant may include one or more of blends comprising one or more of HFC-32 (preferably in amounts of from about 0% to about 22% by weight), HFO-1234ze (preferably in amounts of from about 0% to about 78% by weight), HFO-1234yf (preferably in amounts of from about 0% to about 78% by weight) and propane. The second heat transfer compositions of the present invention, in contrast to the first heat transfer composition, generally does not include lubricant since this fluid is not required to pass through a compressor.

The first heat transfer composition also generally includes a lubricant, generally in amounts of from about 30 to about 50 percent by weight of the heat transfer composition based on the total weight of the refrigerant and other optional components that are present in the system. Other optional components include a compatibilizer, such as propane, for the purpose of aiding compatibility and/or solubility of the lubricant. When present, such compatibilizers, including propane, butanes and pentanes, are preferably present in amounts of from about 0.5 to about 5 percent by weight of the composition. Combinations of surfactants and solubilizing agents may also be added to the present compositions to aid oil solubility, as disclosed by U.S. Pat. No. 6,516,837, the disclosure of which is incorporated by reference. Commonly used refrigeration lubricants such as Polyol Esters (POEs) and Poly Alkylene Glycols (PAGs), silicone oil, mineral oil, alkyl benzenes (ABs) and poly(alpha-olefin) (PAO) that are used in refrigeration machinery with hydrofluorocarbon (HFC) refrigerants may be used with the refrigerant compositions of the present invention. The preferred lubricants are POEs.

Embodiments of the Type Illustrated in FIG. 1

In the following descriptions, components or elements of the system which are or can be generally the same or similar in different embodiments are designated with the same number or symbol.

One preferred air conditioning system, designated generally at 10, is illustrated in FIG. 1, wherein the dotted line represents the approximate boundary between the indoor and the outdoor loops, with the compressor 11, condenser 12, intermediate heat exchanger 13 and expansion valve 14, together with any of the associated conduits 15 and 16 and other connecting and related equipment (not shown) being located outdoors. The outdoor loop, which is also sometimes referred to herein as the "high temperature refrigerant circuit," preferably comprises a first heat transfer composition, preferably according to one or more of the preferred embodiments described above, comprising a first refrigerant and lubricant for the compressor, with at least the first refrigerant circulating in the circuit by way of a conduits 15 and 16 and other related conduits and equipment.

The indoor loop, which is also sometimes referred to herein as the "low temperature refrigerant circuit," preferably comprises at least a second heat transfer composition comprising a second refrigerant, wherein said second refrigerant has at least one safety property, such as flammability and toxicity, that is superior to the corresponding safety property of the first refrigerant. In highly preferred embodiments, the second refrigerant is preferably of sufficiently low toxicity to be designated as Class A according to ASHRAE Standard 34, and also preferably is of sufficiently low flammability to have a Class 1 or 2L flammability rating. In highly preferred embodiments, the second refrigerant comprises, preferably consists essentially of, and in some embodiments consists of, HFCO-1233zd, and even more preferably transHFCO-1233zd. In other highly preferred embodiments, the second refrigerant comprises, preferably consists essentially of, and in some embodiments consists of, combinations of HFO-1234ze(E) and 1,1,1,2,3,3,3-heptafluoropropane (HFC-227ea). Those skilled in the art will appreciate in view of the disclosures contained herein that such embodiments of the present invention provide the advantage of utilizing only the relatively safe (low toxicity and low flammability) low GWP refrigerants, such as HFCO-1233zd(E) and HFO-1234ze(E)/HFC-227ea, in a location proximate to the humans or other animals occupying the dwelling or entering the conditioned space, while separating from the humans or animals who are or might be in the dwelling or conditioned space, from the first refrigerant. Accordingly, the preferred configurations and selection of refrigerants permit the provision of systems which benefit from the use of refrigerants that have many desirable properties, such as capacity, efficiency, low GWP and low ODP, but at the same time, possess one or more properties which would otherwise make them highly disadvantageous and/or preclude their use in proximity to the humans or other animals in a confined and/or closed location. Such combinations provide exceptional advantages in terms of all the desirably properties for such refrigerant systems.

In preferred embodiments, the first refrigerant may comprise, for example, one or more of blends comprising one or more of HFC-32 (preferably in amounts of from about 0% to about 22% by weight), HFO-1234ze (preferably in amounts of from about 0% to about 78% by weight), HFO-1234yf (preferably in amounts of from about 0% to about 78% by weight) and propane.

The heat transfer fluid in the outdoor circuit will generally and preferably include lubricant for the compressor generally in amounts of from about 30 to about 50 percent by weight of the heat transfer fluid, with the balance comprising refrigerant and other optional components that may be present. Other optional components include a compatibilizer, such as propane, for the purpose of aiding compatibility and/or solubility of the lubricant. When present, such compatibilizers, including propane, butanes and pentanes, are preferably present in amounts of from about 0.5 to about 5 percent by weight of the composition. Combinations of surfactants and solubilizing agents may also be added to the present compositions to aid oil solubility, as disclosed by U.S. Pat. No. 6,516,837, the disclosure of which is incorporated by reference. Commonly used refrigeration lubricants such as Polyol Esters (POEs) and Poly Alkylene Glycols (PAGs), silicone oil, mineral oil, alkyl benzenes (ABs) and poly(alpha-olefin) (PAO) that are used in refrigeration machinery with hydrofluorocarbon (HFC) refrigerants may be used with the refrigerant compositions of the present invention. The preferred lubricants are POEs.

In operation, the second refrigerant according to the present invention circulates through the circuit by flowing through the intermediate heat exchanger 13, wherein it transfers heat to the first refrigerant, and in so doing, condenses at least a portion, and preferably substantially all of the second refrigerant to liquid form where it exits the intermediate heat exchanger through conduit 17. In preferred embodiments, the second refrigerant exiting the intermediate heat exchanger enters a receiver 18, wherein a liquid reservoir of the second refrigerant is provided. Although receiver 18 is shown in the Figure as being located indoors, this vessel may also be located outdoors, and it may also be preferred to locate pump 20, when present, outdoors. Liquid refrigerant from the separation vessel is conducted to the evaporator via conduit 21. In the illustration shown in FIG. 1, a liquid pump 20 is shown as assisting in the transport of the liquid refrigerant through conduits 21, 22 and valve 23 to the evaporator 24. However, in other embodiments the second refrigerant liquid can be transported from the receiver using other means or techniques that can be used either alone or in combination with a liquid pump. For example, in some embodiments transport of the liquid refrigerant may be accomplished by using a gravity feed of the liquid to the evaporator, while in other embodiments, a thermal siphon arrangement can be utilized to transport the second liquid refrigerant to the evaporator 24 and from the evaporator to the intermediate heat exchanger 13.

In preferred embodiments in which the refrigerant comprises at least about 90% by weight, preferably consisting essentially of, and preferably consisting of, either HCFO-1233zd(E) or HFO-1234ze(E), the operating conditions correspond to the values described in the table below:

| HIGH TEMPERATURE CIRCUIT | | PREFERRED RANGE |
|---|---|---|
| COMPRESSOR SUCTION | Temperature, C. | 0-15 |
| COMPRESSOR DISCHARGE | Temperature, C. | 20-120 |

-continued

| | | |
|---|---|---|
| CONDENSER | Temperature, C. | 10-60 |
| INTERMEDIATE HEAT EXCHANGER DISCHARGE | Temperature, C. | Approx. same as compressor suction |

| LOW TEMPERATURE CIRCUIT | | PREFERRED RANGE |
|---|---|---|
| RECEIVER DISCHARGE | Temperature, C. | 0-10 |
| EVAPORATOR | Temperature, C. | 0-10 |
| INTERMEDIATE HEAT EXCHANGER INLET | Temperature, C. | 10-20 |
| INTERMEDIATE HEAT EXCHANGER OUTLET | Temperature, C. | 0-10 |

Figure 2:
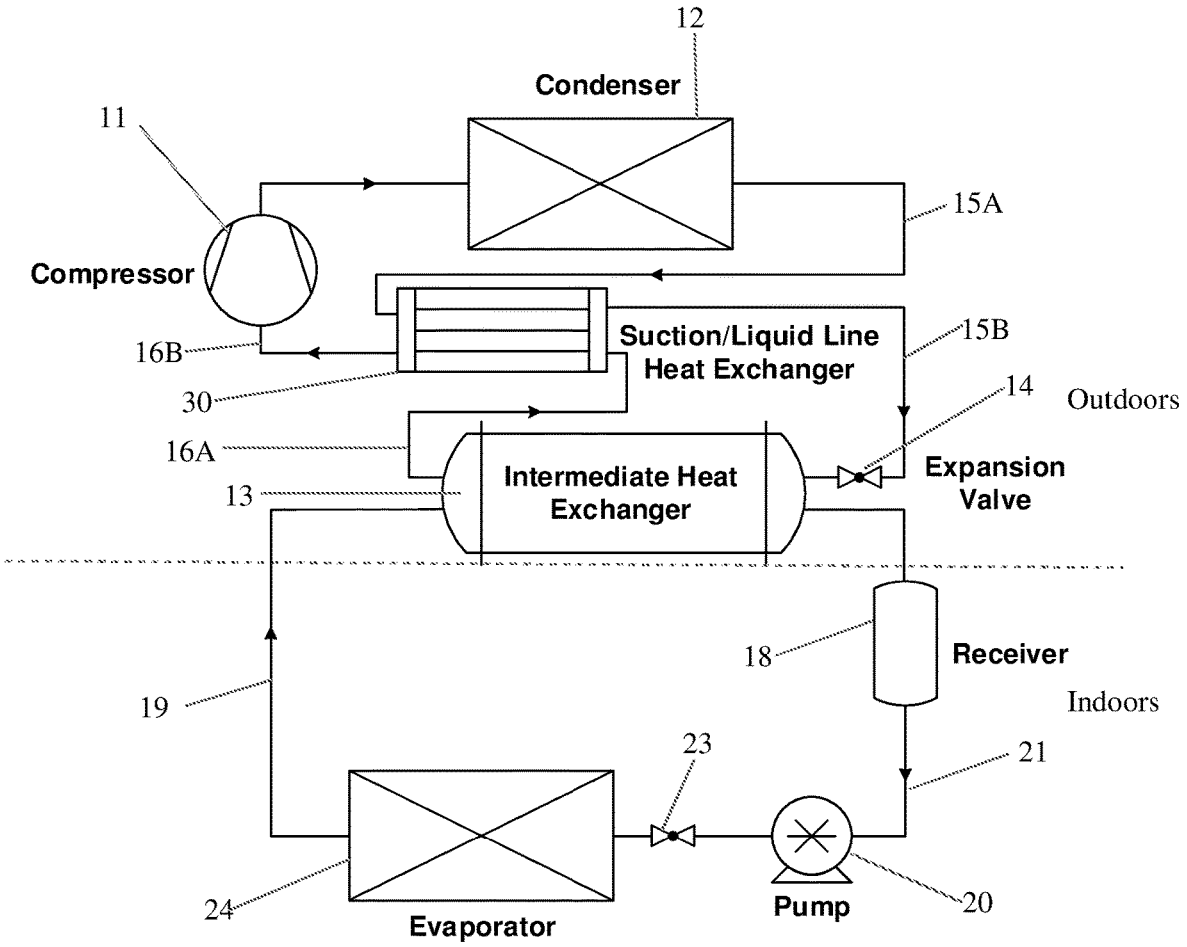
FIG. 2 is a generalized process flow diagram of another preferred embodiment of an air conditioning system according to the present invention.

Embodiments of the Type Illustrated in FIG. 2

Another preferred embodiment of the present invention is illustrated in FIG. 2, with the compressor 11, condenser 12, intermediate heat exchanger 13, expansion valve 14, and suction-line heat exchanger 30, together with any of the associated conduits 15A, 15B, 16A and 16B and other connecting and related equipment (not shown) being located outdoors. The outdoor loop, which is also sometimes referred to herein as the "high temperature refrigerant circuit," preferably comprises a first heat transfer composition comprising a first refrigerant and lubricant for the compressor, with at least the refrigerant circulating in the circuit by way of a conduits 17, 19, 21 and 22 and other related conduits and equipment.

The indoor loop is configured substantially the same as described above in connection with the indoor loop of FIG. 1, and the first and second heat transfer compositions are also preferably as otherwise indicated herein.

In operation, the first refrigerant according to the present invention is discharged from compressor 11 as a relatively high pressure refrigerant vapor, which may include entrained lubricant, and which then enters condenser 12 where it transfers heat, preferably to ambient air, and at least partially condenses. The refrigerant effluent from the condenser 12 is transported via conduit 15A to suction-line heat exchanger 30 where it loses additional heat to the effluent from the intermediate heat exchanger 13. The effluent from the suction/liquid line heat exchanger 30 is then transported via conduit 15B to expansion valve 14 where the pressure of the refrigerant is reduced, which in turn reduces the temperature of the refrigerant. The relatively cold liquid refrigerant from the expansion valve then enters the intermediate heat exchanger 13 where it gains heat from the second refrigerant vapor leaving the evaporator 24 in the indoor loop. The first refrigerant effluent vapor from the intermediate heat exchanger is then transported via conduit 16A to the suction/liquid line heat exchanger 30 where it gains heat from the condenser effluent from conduit 15A and produces second refrigerant vapor at a higher temperature, which is transported by conduit 16B to the inlet of the compressor 11

The evaporator effluent is transported receiver conduit 19 to the intermediate heat exchanger 13 where it loses heat to the effluent from the suction line heat exchanger, which is transported to the intermediate heat exchanger via conduit 15B, and produces a relatively cold stream of the second refrigerant. This cold stream of second refrigerant exiting from the intermediate heat exchanger 13 is transported to receiver tank 18 which provides a reservoir of cold liquid refrigerant which is transported from the tank via conduit 21 and is then fed by way of control valve 23 into the evaporator 24. In some embodiments a pump 20 is provided to provide a flow of liquid to the control valve 23. Ambient air to be cooled loses heat to the cold liquid refrigerant in the evaporator 24, which in turn vaporizes the liquid refrigerant and produces refrigerant vapor with little or no super heat, and this vapor then flows back to the intermediate heat exchanger 13.

In preferred embodiments in which the refrigerant comprises at least about 90% by weight, preferably consisting essentially of, and preferably consisting of, either HCFO-1233zd(E) or HFO-1234ze(E), the operating conditions correspond to the values described in the table below:

| HIGH TEMPERATURE CIRCUIT | | PREFERRED RANGE |
|---|---|---|
| COMPRESSOR SUCTION | Temperature, C. | 0-10 |
| COMPRESSOR DISCHARGE | Temperature, C. | 20-70 |
| CONDENSER | Temperature, C. | 10-60 |

Figure 3:
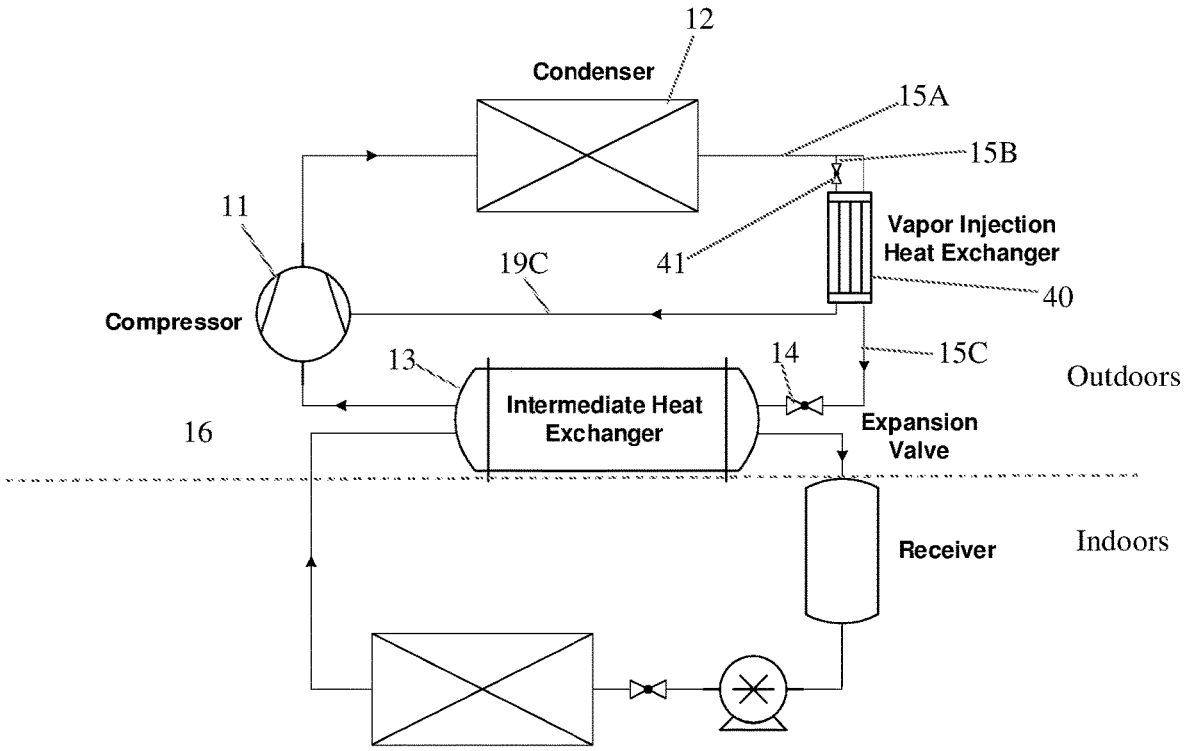
FIG. 3 is a generalized process flow diagram of another preferred embodiment of an air conditioning system according to the present invention.

Embodiments of the Type Illustrated in FIG. 3

Another preferred embodiment of the present invention is illustrated in FIG. 3, with the two-stage compressor 11, condenser 12, intermediate heat exchanger 13, expansion valve 14, and vapor-injection heat exchanger 40, including associated intermediate expansion valve 41, together with any of the associated conduits 15A-15 and other connecting and related equipment (not shown and/or not labeled), being located outdoors. The outdoor loop, which is also sometimes referred to herein as the "high temperature refrigerant circuit," preferably comprises a first heat transfer composition comprising a first refrigerant and lubricant for the compressor, with at least the refrigerant circulating in the circuit by way of a conduits 15 and 16 and other related conduits and equipment.

The indoor loop is configured substantially the same as described above in connection with the indoor loop of FIG. 1, and the first and second heat transfer compositions are also preferably as otherwise indicated herein.

In operation, the first refrigerant according to the present invention, which may include entrained lubricant, is discharged from compressor 11 as a relatively high pressure refrigerant vapor, which may include entrained lubricant, and which then enters condenser 12 where is its transfers heat, preferably to ambient air and at least partially condenses. The effluent stream from the condenser 12 comprising at least partially, and preferably substantially fully, condensed refrigerant. The refrigerant effluent from the condenser 12 is transported via conduit 15A, and a portion of the refrigerant effluent is routed via conduit 15B to an intermediate expansion device 41 and another portion of the effluent, preferably the remainder of the effluent, is transported to the vapor injection heat exchanger 40.

The intermediate expansion device 41 lets the pressure of the effluent stream down, preferably substantially isoenthalpically, to about the pressure of the second stage suction of compressor 11 or sufficiently above such pressure to account for the pressure-drop through the heat exchanger 41 and associated conduits, fixtures and the like. As a result of the pressure drop across the expansion device 41, the pressure of the refrigerant flowing to the heat exchanger 40 is reduced relative to the temperature of the high pressure refrigerant which flows to the heat exchanger 40. Heat is transferred in the heat exchanger 40 from the high pressure stream to the stream that passed through the expansion valve 41. As a result, the temperature of the intermediate pressure stream which exits the heat exchanger 40 is higher, than the temperature of the inlet stream, thereby producing a superheated vapor stream that is transported to the second stage of the compressor 11 via conduit 19C.

As the higher pressure stream transported by conduit 15A travels through the heat exchanger 40 it loses heat to the lower pressure stream exiting expansion device 41 and exits the heat exchanger through conduit 15C and then flows to expansion device 14 and is heat then forwarded to the intermediate heat exchanger where it gains heat and is transported to the first stage of the compressor suction.

In preferred embodiments in which the refrigerant comprises at least about 90% by weight, preferably consisting essentially of, and preferably consisting of, either HCFO-1233zd(E) or HFO-1234ze(E), the operating conditions correspond to the values described in the table below:

| HIGH TEMPERATURE CIRCUIT | | PREFERRED RANGE |
|---|---|---|
| COMPRESSOR SUCTION - $1^{ST}$ STAGE | Temperature, C. | 0-10 |
| COMPRESSOR SUCTION - 2ND STAGE | Temperature, C. | 0-10 |
| COMPRESSOR DISCHARGE | Temperature, C. | 20-70 |
| CONDENSER | Temperature, C. | 10-60 |

Figure 5:
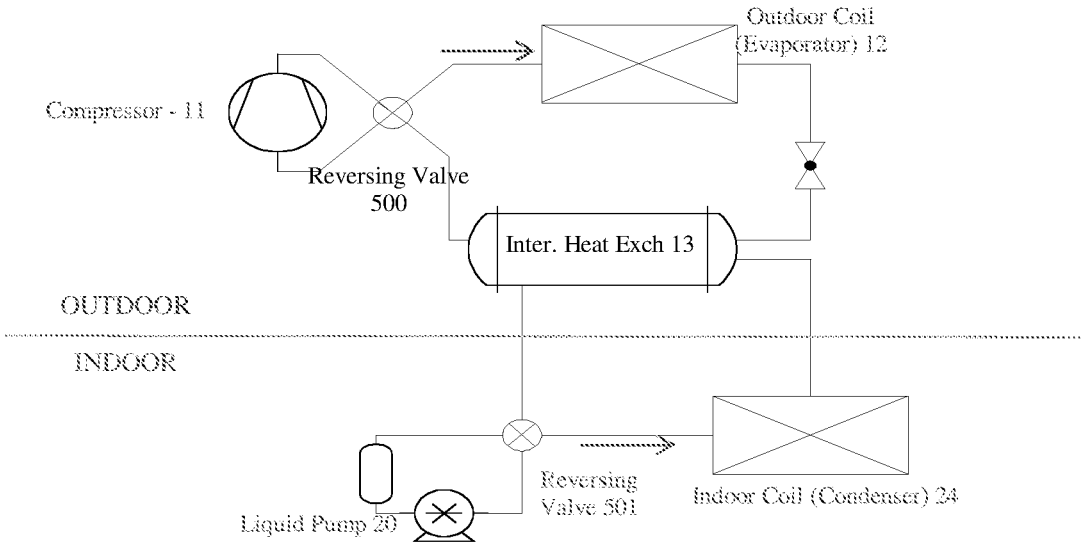
FIG. 5 is a generalized process flow diagram of another preferred embodiment of an air conditioning system which can operate in both a cooling and a heating according to the present invention.

Embodiments of the Type Illustrated in FIG. 5

In the following descriptions, components or elements of the system, which are or can be generally the same or similar in different embodiments are designated with the same number or symbol.

The embodiment disclosed in FIG. 5 is similar to the embodiment of FIG. 1 except the system is equipped with a reversible valve so that it can operate in a heating mode, as described below.

One preferred air conditioning system operable in both a cooling and heating mode is designated generally at 10, is illustrated in FIG. 1, wherein the indicatd line represents the approximate boundary between the indoor and the outdoor loops, with the compressor 11, outdoor coil 12, intermediate heat exchanger 13, expansion valve 14, and reversing valve 500, together with any of the associated conduits 15 and 16 and other connecting and related equipment (not shown) being located outdoors. The outdoor loop preferably comprises a first heat transfer composition, preferably according to one or more of the preferred embodiments described above, comprising a first refrigerant and lubricant for the compressor, with at least the first refrigerant circulating in the circuit by way of a conduits 15 and 16 and other related conduits and equipment.

The indoor loop preferably comprises at least a second heat transfer composition comprising a second refrigerant, wherein said second refrigerant has at least one safety property, such as flammability and toxicity, that is superior to the corresponding safety property of the first refrigerant. In highly preferred embodiments, the second refrigerant is preferably of sufficiently low toxicity to be designated as Class A according to ASHRAE Standard 34, and also preferably is of sufficiently low flammability to have a Class 1 or 2L flammability rating. In highly preferred embodiments, the second refrigerant comprises, preferably consists essentially of, and in some embodiments consists of, HFCO-1233zd, and even more preferably transHFCO-1233zd. In other highly preferred embodiments, the second refrigerant comprises, preferably consists essentially of, and in some embodiments consists of, combinations of HFO-1234ze(E) and 1,1,1,2,3,3,3-heptafluoropropane (HFC-227ea). Those skilled in the art will appreciate in view of the disclosures contained herein that such embodiments of the present invention provide the advantage of utilizing only the relatively safe (low toxicity and low flammability) low GWP refrigerants, such as HFCO-1233zd(E) and HFO-1234ze(E)/HFC-227ea, in a location proximate to the humans or other animals occupying the dwelling or entering the conditioned space, while separating from the humans or animals who are or might be in the dwelling or conditioned space, from the first refrigerant. Accordingly, the preferred configurations and selection of refrigerants permit the provision of systems which benefit from the use of refrigerants that have many desirable properties, such as capacity, efficiency, low GWP and low ODP, but at the same time, possess one or more properties which would otherwise make them highly disadvantageous and/or preclude their use in proximity to the humans or other animals in a confined and/or closed location. Such combinations provide exceptional advantages in terms of all the desirably properties for such refrigerant systems.

In preferred embodiments, the first refrigerant may comprise, for example, one or more of blends comprising one or more of HFC-32 (preferably in amounts of from about 0% to about 22% by weight), HFO-1234ze (preferably in amounts of from about 0% to about 78% by weight), HFO-1234yf (preferably in amounts of from about 0% to about 78% by weight) and propane.

The heat transfer fluid in the outdoor circuit will generally and preferably include lubricant for the compressor generally in amounts of from about 30 to about 50 percent by weight of the heat transfer fluid, with the balance comprising refrigerant and other optional components that may be present. Other optional components include a compatibilizer, such as propane, for the purpose of aiding compatibility and/or solubility of the lubricant. When present, such compatibilizers, including propane, butanes and pentanes, are preferably present in amounts of from about 0.5 to about 5 percent by weight of the composition. Combinations of surfactants and solubilizing agents may also be added to the present compositions to aid oil solubility, as disclosed by U.S. Pat. No. 6,516,837, the disclosure of which is incorporated by reference. Commonly used refrigeration lubricants such as Polyol Esters (POEs) and Poly Alkylene Glycols (PAGs), silicone oil, mineral oil, alkyl benzenes (ABs) and poly(alpha-olefin) (PAO) that are used in refrigeration machinery with hydrofluorocarbon (HFC) refrigerants may be used with the refrigerant compositions of the present invention. The preferred lubricants are POEs.

In operation, the second refrigerant according to the heating mode embodiment of FIG. 5 of the present invention circulates through the circuit by flowing through the intermediate heat exchanger 13, wherein it picks-up heat from the first refrigerant, and in so doing, vaporizes at least a portion, and preferably substantially all of the second refrigerant to vapor form where it exits the intermediate heat exchanger through conduit 17. Vaporous refrigerant is conducted to the condenser via conduit 21 where it rejects heat into the dwelling as it condenses. In the illustration shown in FIG. 1, a liquid pump 20 is shown as assisting in the transport of the liquid refrigerant through conduits 21, 22 and valve 23 to the condenser 24. In addition, this indoor loop also includes a reversible valve 501 which allows the system to operate in both the heating and the cooling mode.

In preferred embodiments in which the refrigerant comprises at least about 90% by weight, preferably consisting essentially of, and preferably consisting of, either HCFO-1233zd(E) or HFO-1234ze(E).

EXAMPLES

Comparative Example 1

An air conditioning system according to a typical arrangement which uses R-410A as the refrigerant is operated according to the following parameters:

Operating Conditions—R410A Basic Cycle

1. Condensing temperature=45° C., corresponding outdoor ambient temperature=35° C.
2. Condensing Temperature—Ambient Temperature=10° C.
3. Expansion device sub-cooling=5.0° C.
4. Evaporating temperature=7° C., corresponding indoor room temperature=27° C.
5. Evaporator Superheat=5.0° C.
6. Isentropic Efficiency=72%
7. Volumetric Efficiency=100%

The capacity and COP of this system is determined using as base-line values for determining the relative capacity and COP in the following examples.

Example 1A

Example 1A (FIG. 1) Operating Conditions

A system configured as illustrated herein in FIG. 1 is operated according to the following operating parameters using a series of different first (outdoor) and second (indoor) refrigerants:

1. Condensing temperature=45° C., corresponding outdoor ambient temperature=35° C.
2. Condensing Temperature—Ambient Temperature=10° C.
3. Expansion device sub-cooling=5.0° C.
4. Evaporating temperature=7° C., corresponding indoor room temperature=27° C.
5. Evaporator Superheat=0.0° C. (flooded)
6. Intermediate Heat Exchanger Superheat=5.0° C.
7. Isentropic Efficiency=72%
8. Volumetric Efficiency=100%
9. Difference of saturation temperatures intermediate heat exchanger=5° C.

The results are provided (with percentages for blends shown in weight %) in Table 1A below:

TABLE 1A

| First (Outdoor) Refrigerant | Second (Indoor) Refrigerant | GWP Primary | GWP Secondary | Capacity | Efficiency |
|---|---|---|---|---|---|
| R410A | NA | 1924 | | 100% | 100% |
| Propane | R1233zd | 3 | 1 | 100% | 90% |
| R1234yf | R1233zd | 1 | 1 | 100% | 88% |
| R1234ze | R1233zd | 1 | 1 | 100% | 92% |
| R32/R1234yf (10.0%/90.0%) | R1233zd | 69 | 1 | 100% | 88% |
| R32/R1234ze (10.0%/90.0%) | R1233zd | 69 | 1 | 100% | 91% |
| R32/R1234yf (22.0%/79.0%) | R1233zd | 150 | 1 | 100% | 88% |
| R32/R1234ze (21.0%/79.0%) | R1233zd | 150 | 1 | 100% | 91% |

As can be seen from the above results, each of the air-conditioning systems according to the present invention were capable of providing a precise capacity match to a prior R410A air-conditioning system operated as indicated and a COP (efficiency) that in all cases is at least 85% relative to such prior systems. Importantly, in all cases, the system utilizes refrigerants that each have a GWP of less than 150, which is approximately a 10 times improvement of the refrigeration system based upon R-410A. The ability to achieve this combination of properties this is a highly beneficial but unexpected result.

Example 1B (FIG. 1) Operating Conditions

A system configured as illustrated herein in FIG. 1 is operated according to the same operating parameters using a series of different first (outdoor) and second (indoor) refrigerants, except that the condensing temperature is adjusted for each blend in order to obtain an efficiency that substantially matches the efficiency achieved according to Comparative Example 1. The results are provided in Table 1B below:

TABLE 1B

| Primary Refrigerant | Secondary Refrigerant | GWP Primary | GWP Secondary | Tcond (° C.) | Efficiency |
|---|---|---|---|---|---|
| R410A | | 1924 | | 45.0 | 100% |
| Propane | R1233zd | 3 | 1 | 41.7 | 100% |
| R1234yf | R1233zd | 1 | 1 | 41.2 | 100% |
| R1234ze | R1233zd | 1 | 1 | 42.2 | 100% |
| R32/R1234yf (10.0%/90.0%) | R1233zd | 69 | 1 | 41.1 | 100% |
| R32/R1234ze (10.0%/90.0%) | R1233zd | 69 | 1 | 42.1 | 100% |
| R32/R1234yf (21.0%/79.0%) | R1233zd | 150 | 1 | 41.0 | 100% |
| R32/R1234ze (21.0%/79.0%) | R1233zd | 150 | 1 | 42.0 | 100% |

The above results indicated that it is possible, with only a relatively small variation in condenser temperature, to achieve systems according to the present invention that produce an efficiency substantially matching that of systems based upon R-410A. As an alternative, the efficiency according to the present methods is preferably increased, without reducing or altering the comparative condenser temperature, by providing a slight increase in heat transfer area in the condenser compared to the amount of heat transfer area in the condenser used with the comparative R-410A system. In addition, the system according to FIG. 2 which utilizes a suction line heat exchanger shows an advantageous improvement in efficiency compared even to the configuration of the present invention without such a heat exchanger as reported in Example 1A.

Example 1C (FIG. 1) Alteration of Ambient Conditions

A system configured as illustrated herein in FIG. 1 is operated according to the same operating parameters as Example 1A using a series of different first (outdoor) and second (indoor) refrigerants, except that the ambient temperature is adjusted to 35 C, 45 C and 55 C for each blend. The results are provided in Table 1C below:

TABLE 1C

| Primary Refrigerant | Secondary Refrigerant | GWP Primary | GWP Secondary | Efficiency @35° C. | Efficiency @45° C. | Efficiency @55° C. |
|---|---|---|---|---|---|---|
| R410A | | 1924 | | 100% | 100% | 100% |
| Propane | R1233zd | 3 | 1 | 100% | 101% | 104% |
| R1234yf | R1233zd | 1 | 1 | 100% | 104% | 109% |
| R1234ze | R1233zd | 1 | 1 | 100% | 102% | 104% |
| R32/R1234yf (10.0%/90.0%) | R1233zd | 69 | 1 | 100% | 104% | 109% |
| R32/R1234ze (10.0%/90.0%) | R1233zd | 69 | 1 | 100% | 101% | 104% |
| R32/R1234yf (21.0%/79.0%) | R1233zd | 150 | 1 | 100% | 103% | 110% |
| R32/R1234ze (21.0%/79.0%) | R1233zd | 150 | 1 | 100% | 103% | 109% |

The above results indicated that it is possible to provide superior performance according to embodiments of the present invention compared to R-410A systems as the ambient temperatures rise above 35 C.

Example 2A

Example 2A (FIG. 2) Operating Conditions

A system configured as illustrated herein in FIG. 2 is operated according to the following operating parameters using a series of different first (outdoor) and second (indoor) refrigerants:

1. Condensing temperature=45° C., corresponding outdoor ambient temperature=35° C.
2. Condensing Temperature—Ambient Temperature=10° C.
3. Expansion device sub-cooling=5.0° C.
4. Evaporating temperature=7° C., corresponding indoor room temperature=27° C.
5. Evaporator Superheat=0.0° C. (flooded)
6. Intermediate Heat Exchanger Superheat=5.0° C.
7. Isentropic Efficiency=72%
8. Volumetric Efficiency=100%
9. Difference of saturation temperatures intermediate heat exchanger=5° C.

The results are provided (with percentages for blends shown in weight %) in Table 2A below:

TABLE 2A

| Primary Refrigerant | Secondary Refrigerant | GWP Primary | GWP Secondary | Efficiency@ 0% effect. | Efficiency@ 35% effect. | Efficiency@ 55% effect. | Efficiency@ 75% effect. | Efficiency@ 85% effect. |
|---|---|---|---|---|---|---|---|---|
| R410A | | 1924 | | 100% | 100% | 100% | 100% | 100% |
| Propane | R1233zd | 3 | 1 | 90% | 91% | 92% | 92% | 93% |
| R1234yf | R1233zd | 1 | 1 | 88% | 91% | 92% | 93% | 94% |
| R1234ze | R1233zd | 1 | 1 | 92% | 93% | 94% | 95% | 96% |
| R32/R1234yf (10.0%/90.0%) | R1233zd | 69 | 1 | 88% | 90% | 91% | 92% | 93% |
| R32/R1234ze (10.0%/90.0%) | R1233zd | 69 | 1 | 91% | 93% | 94% | 95% | 95% |
| R32/R1234yf (22.0%/79.0%) | R1233zd | 150 | 1 | 88% | 89% | 89% | 90% | 91% |
| R32/R1234ze (22.0%/79.0%) | R1233zd | 150 | 1 | 91% | 92% | 92% | 93% | 93% |

As can be seen from the above results, each of the air-conditioning systems according to the present invention were capable of providing a precise capacity match to a prior R410A air-conditioning system operated as indicated and a COP (efficiency) that in all cases is at least 90% relative to such prior systems. Importantly, in all cases, the system utilizes refrigerants that each have a GWP of less than 150, which is approximately a 10 times improvement of the refrigeration system based upon R-410A. The ability to achieve this combination of properties this is a highly beneficial but unexpected result.

Example 2B

Example 2B (FIG. 2)—Alteration of Condenser Temperature

A system configured as illustrated herein in FIG. 2 is operated according to the same operating parameters as Example 2A using a series of different first (outdoor) and second (indoor) refrigerants, except that the condensing temperature is adjusted for each blend in order to obtain an efficiency that substantially matches the efficiency achieved according to Comparative Example 1. The results are provided in Table 2B below:

TABLE 2B

| Primary Refrigerant | Secondary Refrigerant | GWP Primary | GWP Secondary | Tcond (° C.) @ 0% effect. | Tcond (° C.) @ 35% effect. | Tcond (° C.) @ 55% effect. | Tcond (° C.) @ 75% effect. | Tcond (° C.) @ 85% effect. |
|---|---|---|---|---|---|---|---|---|
| R410A | | 1924 | | 45.0 | 45.0 | 45.0 | 45.0 | 45.0 |
| Propane | R1233zd | 3 | 1 | 41.7 | 41.9 | 42.1 | 42.3 | 42.4 |
| R1234yf | R1233zd | 1 | 1 | 41.2 | 41.8 | 42.2 | 42.6 | 42.8 |
| R1234ze | R1233zd | 1 | 1 | 42.2 | 42.7 | 43.0 | 43.3 | 43.5 |
| R32/R1234yf (10.0%/90.0%) | R1233zd | 69 | 1 | 41.1 | 41.6 | 41.9 | 42.3 | 42.5 |
| R32/R1234ze (10.0%/90.0%) | R1233zd | 69 | 1 | 42.1 | 42.5 | 42.8 | 43.1 | 43.3 |
| R32/R1234yf (22.0%/79.0%) | R1233zd | 150 | 1 | 41.0 | 41.2 | 41.4 | 41.6 | 41.7 |
| R32/R1234ze (22.0%/79.0%) | R1233zd | 150 | 1 | 42.0 | 42.2 | 42.4 | 42.5 | 42.6 |

The above results indicate that it is possible, with only a relatively small variation in condenser temperature, to achieve systems according to the present invention that produce an efficiency substantially matching that of systems based upon R-410A. As an alternative, the efficiency according to the present methods is preferably increased, without reducing or altering the comparative condenser temperature, by providing a slight increase in heat transfer area in the condenser compared to the amount of heat transfer area in the condenser used with the comparative R-410A system.

Example 2C

Example 2C (FIG. 2)—Alteration of Ambient Conditions

A system configured as illustrated herein in FIG. 2 is operated according to the same operating parameters as Example 2A using a series of different first (outdoor) and second (indoor) refrigerants, except that the ambient temperature is adjusted to 35 C, 45 C and 55 C for each blend. The results are provided in Table 2C below:

TABLE 2C

| Primary Refrigerant | Secondary Refrigerant | GWP Primary | GWP Secondary | Efficiency @35° C. | Efficiency @45° C. | Efficiency @55° C. |
|---|---|---|---|---|---|---|
| R410A | | 1924 | | 100% | 100% | 100% |
| Propane | R1233zd | 3 | 1 | 100% | 106% | 115% |
| R1234yf | R1233zd | 1 | 1 | 100% | 106% | 115% |
| R1234ze | R1233zd | 1 | 1 | 100% | 107% | 118% |
| R32/R1234yf (10.0%/90.0%) | R1233zd | 69 | 1 | 100% | 105% | 113% |
| R32/R1234ze (10.0%/90.0%) | R1233zd | 69 | 1 | 100% | 107% | 116% |
| R32/R1234yf (22.0%/79.0%) | R1233zd | 150 | 1 | 100% | 105% | 111% |
| R32/R1234ze (22.0%/79.0%) | R1233zd | 150 | 1 | 100% | 106% | 115% |

The above results indicated that it is possible to provide superior performance according to embodiments of the present invention compared to R-410A systems as the ambient temperatures rise above 35 C.

Example 3A

Example 3A (FIG. 3) Operating Conditions

A system configured as illustrated herein in FIG. 3 is operated according to which according to the following operating parameters using a series of different first (outdoor) and 100% transHFCO-1233zd as the indoor refrigerant:

1. Condensing temperature=45° C., corresponding outdoor ambient temperature=35° C.
2. Condensing Temperature—Ambient Temperature=10° C.
3. Expansion device sub-cooling=5.0° C.
4. Evaporating temperature=7° C., corresponding indoor room temperature=27° C.
5. Evaporator Superheat=0.0° C. (flooded)
6. Intermediate Heat Exchanger Superheat=5.0° C.
7. Isentropic Efficiency for both stages=72%
8. Volumetric Efficiency=100%

9. Difference of saturation temperatures in intermediate heat exchanger=5° C.

10. Vapor Injection Heat Exchanger Effectiveness=35%, 55%, 75%, 85%

The results are provided (with percentages for blends shown in weight %) in Table 3A below:

TABLE 3A

| Primary Refrigerant | Secondary Refrigerant | GWP Primary | GWP Secondary | Efficiency@ 35% effect. | Efficiency@ 55% effect. | Efficiency@ 75% effect. | Efficiency@ 85% effect. |
|---|---|---|---|---|---|---|---|
| R410A | | 1924 | | 100% | 100% | 100% | 100% |
| Propane | R1233zd | 3 | 1 | 92% | 93% | 95% | 96% |
| R1234yf | R1233zd | 1 | 1 | 91% | 93% | 95% | 95% |
| R1234ze | R1233zd | 1 | 1 | 94% | 95% | 97% | 98% |
| R32/R1234yf (10.0%/90.0%) | R1233zd | 69 | 1 | 93% | 96% | 99% | 100% |
| R32/R1234ze (10.0%/90.0%) | R1233zd | 69 | 1 | 98% | 101% | 104% | 105% |
| R32/R1234yf (22.0%/79.0%) | R1233zd | 150 | 1 | 93% | 96% | 98% | 100% |
| R32/R1234ze (22.0%/79.0%) | R1233zd | 150 | 1 | 99% | 102% | 105% | 106% |

As can be seen from the above results, each of the air-conditioning systems according to the present invention were capable of providing a precise capacity match to a prior R410A air-conditioning system operated as indicated and a COP (efficiency) that in all cases is at least 90% relative to such prior systems. Importantly, in all cases, the system utilizes refrigerants that each have a GWP of less than 150, which is approximately a 10 times improvement of the refrigeration system based upon R-410A. The ability to achieve this combination of properties this is a highly beneficial but unexpected result.

Example 3B

Example 3B (FIG. 3)—Alteration of Condenser Temperature

A system configured as illustrated herein in FIG. 3 is operated according to the same operating parameters as Example 3A using a series of different first (outdoor) and 100% transHFCO-1233zd as the indoor refrigerant, except that the condensing temperature is adjusted for each blend in order to obtain an efficiency that substantially matches the efficiency achieved according to Comparative Example 1. The results are provided in Table 3B below:

TABLE 3B

| Primary Refrigerant | Secondary Refrigerant | GWP Primary | GWP Secondary | Tcond (° C.) @ 35% effect. | Tcond (° C.) @ 55% effect. | Tcond (° C.) @ 75% effect. | Tcond (° C.) @ 85% effect. |
|---|---|---|---|---|---|---|---|
| R410A | | 1924 | | 45.0 | 45.0 | 45.0 | 45.0 |
| Propane | R1233zd | 3 | 1 | 42.2 | 42.7 | 43.2 | 43.6 |
| R1234yf | R1233zd | 1 | 1 | 41.9 | 42.5 | 43.0 | 43.4 |
| R1234ze | R1233zd | 1 | 1 | 42.8 | 43.4 | 44.0 | 44.4 |
| R32/R1234yf (10.0%/90.0%) | R1233zd | 69 | 1 | 43.0 | 43.8 | 44.5 | 45.0 |
| R32/R1234ze (10.0%/90.0%) | R1233zd | 69 | 1 | 44.4 | 45.0 | 45.0 | 45.0 |
| R32/R1234yf (22.0%/79.0%) | R1233zd | 150 | 1 | 43.0 | 43.7 | 44.5 | 45.0 |
| R32/R1234ze (22.0%/79.0%) | R1233zd | 150 | 1 | 44.8 | 45.0 | 45.0 | 45.0 |

The above results indicate that it is possible, with only a relatively small variation in condenser temperature, to achieve systems according to the present invention that produce an efficiency substantially matching that of systems based upon R-410A. As an alternative, the efficiency according to the present methods is preferably increased, without reducing or altering the comparative condenser temperature, by providing a slight increase in heat transfer area in the condenser compared to the amount of heat transfer area in the condenser used with the comparative R-410A system.

Example 3C

Example 3C (FIG. 3)—Alteration of Ambient Conditions

A system configured as illustrated herein in FIG. 3 is operated according to the same operating parameters as Example 2A using a series of different first (outdoor) and second (indoor) refrigerants, except that the ambient temperature is adjusted to 35 C, 45 C and 55 C for each blend. The results are provided in Table 3C below:

| Primary Refrigerant | Secondary Refrigerant | GWP Primary | GWP Secondary | Efficiency @35° C. | Efficiency @45° C. | Efficiency @55° C. |
|---|---|---|---|---|---|---|
| R410A | | 1924 | | 100% | 100% | 100% |
| Propane | R1233zd | 3 | 1 | 100% | 107% | 117% |
| R1234yf | R1233zd | 1 | 1 | 100% | 106% | 115% |
| R1234ze | R1233zd | 1 | 1 | 100% | 108% | 118% |
| R32/R1234yf (10.0%/90.0%) | R1233zd | 69 | 1 | 100% | 105% | 112% |
| R32/R1234ze (10.0%/90.0%) | R1233zd | 69 | 1 | 103% | 109% | 118% |
| R32/R1234yf (22.0%/79.0%) | R1233zd | 150 | 1 | 100% | 104% | 111% |
| R32/R1234ze (22.0%/79.0%) | R1233zd | 150 | 1 | 104% | 110% | 118% |

The above results indicated that it is possible to provide superior performance according to embodiments of the present invention compared to R-410A systems as the ambient temperatures rise above 35 C.

Example 4

The air conditioning system of Example 1 is operated with an indoor refrigerant comprising various binary mixtures of transHCFO-1233zd and transHFO-1234ze using evaporator temperatures ranging from about −1 C to about 10 C, which generally encompasses the condenser temperatures that are used in many important air conditioning systems. The results of the testing are reported in Table 4A below:

TABLE 4A

| Secondary Refrigerant | Evaporator Temperature (° C.) | Evaporator Pressure (bar) |
|---|---|---|
| R1233zd | −1 | 0.46 |
| | 5 | 0.60 |
| | 10 | 0.73 |
| R1233zd/R1234ze | −1 | 1.02 |
| (50%/50%) | 5 | 1.29 |
| | 10 | 1.55 |
| R1233zd/R1234ze | −1 | 1.27 |
| (33%/67%) | 5 | 1.60 |
| | 10 | 1.92 |

Applicants have found that the compositions in which the amount of transHFO-1234ze is at least about 50% by weight, as illustrated above in Table 4, permit the indoor circuit to operate under pressures greater than one atmosphere, thereby avoiding the need for a purge system, while at the same time providing a system pressure sufficiently low to allow the use of relatively low-cost vessels and conduits and/or to advantageously avoid refrigerant leaks that might otherwise occur in high pressure systems. In addition, applicants have tested the flammability of transHFO-1234ze/transHCFO-1233zd the blends on fractionation flammability, which is relevant to the flammability of the refrigerant in the event of a leak from the system, and the result of this work is reported in Table 4B below:

TABLE 4B

| Temperature for Worst Case Fractionation | Nominal Composition (wt %) | | Initial Vapor Composition (wt %) | | Flamma- |
|---|---|---|---|---|---|
| (° C.) | R1233zd | R1234ze | R1233zd | R1234ze | bility |
| 3.3 | 50.0 | 50.0 | 19.6 | 80.4 | Non-flammable |
| 0.2 | 40.0 | 60.0 | 13.4 | 86.6 | Non-flammable |
| −1.5 | 34.0 | 66.0 | 10.4 | 89.6 | Non-flammable |
| −1.8 | 33.0 | 67.0 | 9.9 | 90.1 | Non-flammable |
| −2.1 | 32.0 | 68.0 | 9.5 | 90.5 | Flam-mable |

Based on the results reported in Table 4B above, applicants have found that liquid blends having in excess of 67% by weight of transHFO-1234ze are flammable as measured according to the fraction test, which is conducted in accordance with ASTM 34 and that according to the results in Table 4A amounts of transHFO-1234ze less than about 50% by weight (that is, transHFCO-1233zd greater than 50%) produce the possibility of a negative system pressure.

Example 5—Compatibility with Plastics Useful in Low Pressure Systems

Applicants have tested the stability of various plastic materials when exposed to transHFCO-1233zd by submerging samples of various plastics in transHFCO-1233zd under amient pressure conditions at room temperature (approximately24° C.-25° C.) for two (2) weeks, after which the samples were removed from the transHFCO-1233zd and allowed to outgas for 24 hours. The results are reported in Table 5 below:

| SUBSTRATE (Plastics) | AVE % WT. Δ | AVE % VOL. Δ |
|---|---|---|
| ABS | 3.35% | 3.55% |
| DELRIN ® | 0.54% | 0.61% |
| HDPE | 1.70% | 1.19% |
| NYLON 66 | −0.09% | −0.09% |
| POLYCARBONATE | 3.55% | 2.98% |
| ULTEM ® Polyetherimide | 0.035% | −0.52% |
| KYNAR ® PVDF | 0.13% | −0.27% |
| TEFLON ® | 2.13% | 3.93% |
| POLYPROPYLENE | 4.96% | 3.68% |
| PVC-TYPE 1 | 0.10% | 0.04% |
| PET | 0.08% | 0.015% |

As illustrated by the results in Table 5 above, the average percent volume change for each of the tested plastic materials is less than 5%.

Example 6

Figure 4:
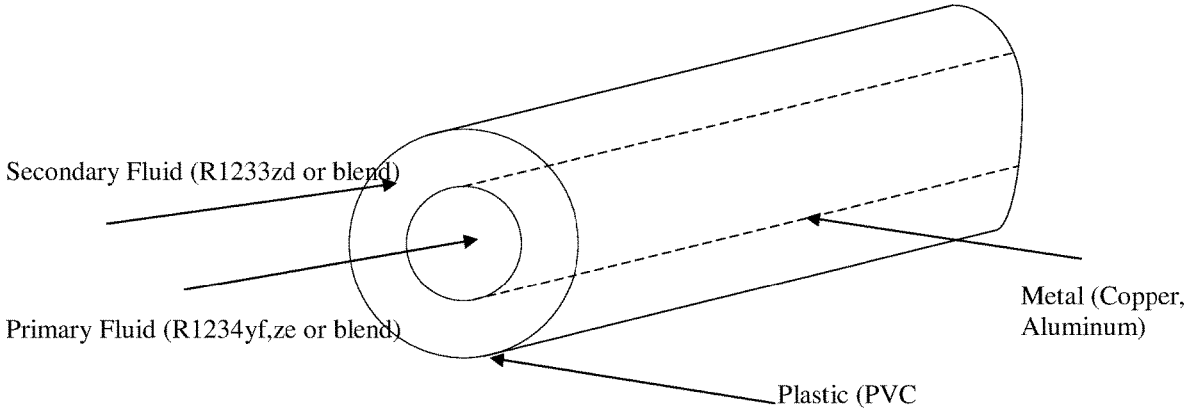
FIG. 4 is a schematic representation of heat exchanger according to one embodiment of the present invention.

The air conditioning system of Example 1 is operated under a condition in which there is an inadvertent leak of the high temperature refrigerant, which is a A2L refrigerant into the low temperature non-flammable refrigerant according to ASHRAE 34 comprising any of the preferred low temperature refrigerants of the present invention, including refrigerants comprising HFO-1234ze(E), HFCO-1233zd(E) and combinations of these. In such a case the A2L (mildly-flammable) refrigerant mixes with non-flammable low temperature refrigerant in the case of an inadvertent leak inside intermediate heat exchanger. The resulting mixture of low temperature refrigerant (e.g., R1233zd(E)) and A2L refrigerant could eventually leak into the indoors. However, in many instances the leak into the indoors will be a non-flammable material. In certain embodiments the accumulator can be used, together with appropriate controls, to ensure that the proper charge ratio is maintained between high side and low side to ensure non-flammable mixture. It may also be possible to incorporate into the present systems A device or devices that can detect a leak of flammable refrigerant into the indoor loop and release all such refrigerant outside the home. One such leak detection system is disclosed in U.S. application Ser. No. 15/400,891, filed Jan. 6, 2017 (see particularly FIGS. 4A and 4B) and Provisional Application 62/275,382, filed Jan. 6, 2016, each of which is incorporated herein by reference.

Table 6 shows the charge ratio which in case of a leak event can prevent a hazardous situation to happen inside the dwelling.

TABLE 6

| Leak event in the intermediate heat exchanger | | | | |
|---|---|---|---|---|
| | Composition | | Charge Ratio required in case of a leak event in the intermediate heat exchanger | |
| Number | High-Stage Refrigerant | Low-Stage Refrigerant | R1233zd/High-Stage Refrigerant | Flammability |
| 1 | R1234yf | R1233zd | 73/27 | Non Flammable |
| 2 | R1234ze | R1233zd | 25/75 | Non Flammable |
| 5 | R32/R1234yf (22%/78%) | R1233zd | 85/15 | Non Flammable |
| 6 | R32/R1234ze (22%/78%) | R1233zd | 85/15 | Non Flammable |

Comparative Example 2

A reversible heat pump system according to typical prior art arrangement which uses R-410A as the refrigerant is operated in heating mode according to the following parameters:

Operating Conditions—R410A Basic Cycle

1. Condensing temperature=40° C., corresponding indoor room temperature=21.1° C.
2. Condensing Temperature—Ambient Temperature=19° C.
3. Expansion device sub-cooling=5.0° C.
4. Evaporating temperature=0° C., corresponding outdoor ambient temperature=8.3° C.
5. Evaporator Superheat=5.0° C.
6. Isentropic Efficiency=72%
7. Volumetric Efficiency=100%

The capacity and COP of this system is determined using as base-line values for determining the relative capacity and COP in the following Examples 7A and 7B according to the present invention.

Example 7A

A system configured as illustrated herein in FIG. 6 is operated according to the following operating parameters using a series of different first (outdoor) and second (indoor) refrigerants:

1. Condensing temperature=40° C., corresponding indoor room temperature=21.1° C.
2. Condensing Temperature—Ambient Temperature=19° C.
3. Expansion device sub-cooling=5.0° C.
4. Evaporating temperature=0° C., corresponding outdoor ambient temperature=8.3° C.
5. Evaporator Superheat=0.0° C. (flooded)
6. Intermediate Heat Exchanger Superheat=5.0° C.
7. Isentropic Efficiency=72%
8. Volumetric Efficiency=100%
9. Difference of saturation temperatures intermediate heat exchanger=5° C.

The results are provided (with percentages for blends shown in weight %) in Table 1A below:

TABLE 7A

| First (Outdoor) Refrigerant | Second (Indoor) Refrigerant | GWP Primary | GWP Secondary | Capacity | Efficiency |
|---|---|---|---|---|---|
| R410A | NA | 1924 | | 100% | 100% |
| Propane | R1233zd | 3 | 1 | 100% | 92% |
| R1234yf | R1233zd | 1 | 1 | 100% | 90% |
| R1234ze | R1233zd | 1 | 1 | 100% | 93% |
| R32/R1234yf (10.0%/90.0%) | R1233zd | 69 | 1 | 100% | 90% |
| R32/R1234ze (10.0%/90.0%) | R1233zd | 69 | 1 | 100% | 93% |
| R32/R1234yf (22.0%/79.0%) | R1233zd | 150 | 1 | 100% | 90% |
| R32/R1234ze (21.0%/79.0%) | R1233zd | 150 | 1 | 100% | 91% |

As can be seen from the above results, each of the air-conditioning systems according to the present invention were capable of providing a precise capacity match to a prior R410A air-conditioning system operated as indicated and a COP (efficiency) that in all cases is at least 90% relative to such prior systems. Importantly, in all cases, the system utilizes refrigerants that each have a GWP of less than 150, which is approximately a 10 times improvement of the refrigeration system based upon R-410A. The ability to achieve this combination of properties this is a highly beneficial but unexpected result.

Example 7B (FIG. 5) Operating Conditions

A system configured as illustrated herein in FIG. 5 is operated according to the same operating parameters using a series of different first (outdoor) and second (indoor) refrigerants, except that the condensing temperature is adjusted for each blend in order to obtain an efficiency that substantially matches the efficiency achieved according to Comparative Example 2. The results are provided in Table 7B below:

TABLE 7B

| Primary Refrigerant | Secondary Refrigerant | GWP Primary | GWP Secondary | Tcond (° C.) | Efficiency |
|---|---|---|---|---|---|
| R410A | | 1924 | | 40.0 | 100% |
| Propane | R1233zd | 3 | 1 | 36.4 | 100% |
| R1234yf | R1233zd | 1 | 1 | 35.8 | 100% |
| R1234ze | R1233zd | 1 | 1 | 36.8 | 100% |
| R32/R1234yf (10.0%/90.0%) | R1233zd | 69 | 1 | 35.8 | 100% |
| R32/R1234ze (10.0%/90.0%) | R1233zd | 69 | 1 | 36.7 | 100% |
| R32/R1234yf (21.0%/79.0%) | R1233zd | 150 | 1 | 35.7 | 100% |
| R32/R1234ze (21.0%/79.0%) | R1233zd | 150 | 1 | 36.7 | 100% |

The above results indicated that it is possible, with only a relatively small variation in condenser temperature, to achieve systems according to the present invention that produce an efficiency substantially matching that of systems based upon R-410A. As an alternative, the efficiency according to the present methods is preferably increased, without reducing or altering the comparative condenser temperature, by providing a slight increase in heat transfer area in the condenser compared to the amount of heat transfer area in the condenser used with the comparative R-410A system.

What is claimed is:

1. A refrigeration system for cooling air of a human-occupied space or for cooling an item located in said human-occupied space using air in said human-occupied space, said system comprising, (a) a high temperature refrigerant circuit comprising: (i) a high temperature refrigerant having a Global Warming Potential (GWP) of less than about 500 flowing through at least a portion of said high temperature circuit to reject heat from the system, wherein at least said portion of said high temperature circuit through which said high temperature refrigerant flows is not located within said human-occupied space; (ii) a condenser which provides at least a first condenser effluent stream comprising a liquid high temperature refrigerant stream, at a first temperature; (iii) an expansion valve fluidly connected to said liquid high temperature refrigerant steam front said condenser and which provides a high temperature refrigerant stream, at a second temperature less than said first temperature; (iv) a compressor which provides a vapor stream comprising at least a portion of said refrigerant to said condenser; and (v) an intermediate heat exchanger in which at least a portion of said high temperature refrigerant stream from said expansion valve absorbs heat and which produces a vapor stream comprising said high temperature refrigerant, said vapor stream from said intermediate heat exchanger being in fluid communication with an inlet of said compressor; and (b) a low temperature refrigerant circuit formed at least in part with plastic components comprising: (i) a low temperature refrigerant flowing through at least a portion of said low pressure circuit to absorb heat from said human occupied space, and wherein at least said portion of said low temperature circuit through which low temperature refrigerant flows is located within said human-occupied space and wherein said low temperature circuit operates at pressure greater than one atmosphere, said low temperature refrigerant blend comprising at least about 33% by weight of 1-chloro-3,3,3-trifluoropropene HCFO-1233zd(E) and at least one co-refrigerant in an amount effective to produce a blend that and being (1) is non-flammable according to ASHRAE Standard 34 and (2) has an Occupational Exposure Limit (OEL) greater than 400 and which is classified as class A by ASHRAE Standard 34; and (3) has the GWP of less than about 500; (ii) a receiver containing at least a portion of said low temperature refrigerant in a liquid state; (iii) an evaporator fluidly connected to said receiver which receives liquid low temperature refrigerant from said accumulator and which produces therefrom a low temperature refrigerant stream in a vapor state at a pressure above atmospheric; and (iv) said intermediate heat exchanger of said high temperature refrigerant circuit, wherein said high temperature refrigerant stream from said expansion valve absorbs heat from said low temperature refrigerant vapor from said evaporator, said intermediate heat exchanger producing a liquid effluent stream comprising said low temperature refrigerant, said low temperature liquid effluent stream from said intermediate heat exchanger being in fluid communication with the inlet of said receiver.

2. The refrigeration system of claim 1 further comprising a pump in the line fluidly connecting the liquid outlet from said receiver to the inlet of said evaporator transporting at least a portion of said liquid to said evaporator.

3. The refrigeration system of claim 1 wherein at least a portion of the liquid from said receiver is transported to the inlet of said evaporator by a thermo-syphon effect.

4. The refrigeration system of claim 3 wherein there is no pump in the line fluidly connecting the liquid outlet from said receiver to the inlet of said evaporator.

5. The refrigeration system of claim 1 wherein said high temperature refrigerant comprises difluoromethane (R-32).

6. The refrigeration system of claim 1 wherein said high temperature refrigerant comprises up to about 22% by weight of difluoromethane (R-32).

7. The refrigeration system of claim 1 wherein said high temperature refrigerant comprises R-1234ze.

8. The refrigeration system of claim 1 wherein said high temperature refrigerant comprises up to about 78% by weight of Solstice® ze Refrigerant (1234ze).

9. The refrigeration system of claim 1 wherein said high temperature refrigerant comprises R-1234yf.

10. The refrigeration system of claim 1 wherein said high temperature refrigerant comprises up to about 78% by weight of 2,3,3,3-Tetrafluoropropene (R-1234yf).

11. The refrigeration system of claim 1 wherein said high temperature refrigerant comprises propane.

12. The refrigeration system of claim 1 wherein said high temperature refrigerant comprises from about 10% to about 100% by weight of propane.

13. The refrigeration system of claim 1, wherein said low temperature refrigerant and said high temperature refrigerant each have the global warming potential of less than about 150.

14. The refrigeration system of claim 1 wherein said low temperature refrigerant and said high temperature refrigerant each have the global warming potential of loss than about 1.

15. The refrigeration system of claim 1 wherein said condenser operates at a temperature in the range of from about 35° C. to about 70° C.

16. The refrigeration system of claim 15 wherein said condenser operates at a temperature of about 45° C.

17. The refrigeration system of claim 15 wherein said condenser rejects heat to ambient air at a temperature of from about 20° C. to about 55° C.

18. The refrigeration system of claim 17 wherein said condenser rejects heat to ambient air at a temperature of about 35° C.

19. The refrigeration system of claim 15 having a capacity of from about 95% to about 105% relative to Freon™ (410A).

20. The refrigeration system of 15 having a coefficient of performance (COP) of from about 95% to about 105% relative to Freon™ (410A).

* * * * *